United States Patent [19]

Arce

[11] 4,301,892

[45] Nov. 24, 1981

[54] DEVICE FOR THE ASCENSION AND DESCENSION OF HIGH ALTITUDES

[76] Inventor: Carlos L. Arce, 20-25 W. Mosholu Pkwy. South, Bronx, N.Y. 10468

[21] Appl. No.: 603,730

[22] Filed: Aug. 11, 1975

[51] Int. Cl.[3] ..... A62B 1/12

[52] U.S. Cl. ..... 182/233; 182/5; 182/72

[58] Field of Search ..... 254/151, 154, 158, 160; 182/3, 4, 5, 6, 142, 145, 71, 72, 73, 231–235, 236–240; 188/1 B, 65.5; 251/326

[56] References Cited

U.S. PATENT DOCUMENTS

| | | | |
|---|---|---|---|
| 643,286 | 2/1900 | Feiker | 254/151 |
| 859,266 | 7/1907 | Ulery | 254/158 X |
| 1,122,566 | 12/1914 | Bailey | 254/158 |
| 1,494,467 | 5/1924 | Edwards | 254/154 |
| 2,636,712 | 4/1953 | Lubbock | 251/236 |
| 2,729,425 | 1/1956 | Gschwind | 182/5 X |
| 3,256,916 | 6/1966 | Silletti | 251/326 X |
| 3,844,377 | 10/1974 | Wilkins | 182/73 X |
| 3,850,262 | 11/1974 | Simizu | 182/72 X |
| 3,861,496 | 1/1975 | Hoover | 254/158 X |
| 4,114,726 | 9/1978 | Sentinella | 182/5 |

FOREIGN PATENT DOCUMENTS

| | | | |
|---|---|---|---|
| 790962 | 7/1968 | Canada | 182/5 |

*Primary Examiner*—Joseph F. Peters, Jr.
*Assistant Examiner*—D.W. Underwood
*Attorney, Agent, or Firm*—William T. Hough

[57] ABSTRACT

In a preferred embodiment, a fire emergency descent device utilizing straps is securable onto a persons back, and a spool-mounted line (wire) is controllably releasable through overhead wire guide supports adjustable to alter the hanging position of the strapped-in person, and rate of descent being controllable either manually by a manually-adjustable variable valve and a second valve normally preset to correspond to a persons weight to controllably regulate release of compressed air from a piston cylinder housing in which air becomes compressed by piston action resulting from spinning of the spool (spindle) during descent.

3 Claims, 7 Drawing Figures

DEVICE FOR THE ASCENSION AND DESCENSION OF HIGH ALTITUDES

This invention is directed to an improved device for lowering persons, animals, and property from high elevations, e.g. high-riser buildings, onto the ground.

BACKGROUND TO THE INVENTION

Prior to this invention there have existed portable fire escape devices for escaping from high places such as upper floors of burning buildings. Typical patents are U.S. Pat. No. 1,122,566 to W. F. Bailey utilizing piston action to build pressure of compressed air which serves as a braking device against the excessive feed-out of the wire from the spool mounting the wire, and including a harness by which an object or person would be lowered. U.S. Pat. No. 859,266 likewise illustrates another piston escape device with lowering harness, and a friction-type brake for controlling rate of descent. Also the U.S. Pat. No. 1,494,467 illustrates a different type of friction brake for controlling the rate of spool unwinding and thus wire (cable) release.

BROAD DESCRIPTION OF THE INVENTION

According to the invention, it is proposed to lower a person, animal, or property from a high altitude by means of the utilization of a combination of harness, hard metal framed pack, containing a reel of steel cable (or any other suitable wire-like material), and a wire guide which would channel the cable to a point of exit from the pack which corresponds to the center of gravity of the load suspended from the cable, and maintains said cargo in an upright position.

The loose end of the cable protruding from the wire guide would be anchored to the place from which the descent would begin, for example, a wall, floor, ceiling, furniture . . . As the pack is suspended on the cable and the force of gravity begins to pull, the cable would unreel and begin to exit the pack, following the trajectory imposed on it by the wire-guide.

The device also contains a decelerating system to reduce speed and maintain the rate of descent at a safe level.

The method used for a braking system inside the pack consists of a small metal bar mounted on the frame, as an extension of the frame. When on its forward position said braking bar would engage gear teeth protruding from the sides of the base of the spool. When on its rear position, it would lie parallel to the base of the wheel and apart from it.

The braking bar would be continuously drawn to its rear position by a pull spring connected on one end to the braking bar and on the other end to the pack's frame. It can be brought forwardly to its forward position by a strip of cable that connects on one end to the braking bar and on the other end to a handle outside the pack which can be pulled by the person using the pack, for the purpose of stopping the descent.

The method utilized by this device to decelerate the rate of descent consists of the use of an air piston which would travel back and forth creating air pressure inside the piston tube or piston housing. The entrance and exit of air in the piston housing is controlled by one or more valves. The piston is connected to a shaft that runs from the piston to a small spindle protruding from the top plate of the spool. The spindle is positioned off-center with regard to the top plate of the spool. Thus, the motion of the wheel on the spindle corresponds to motion of the piston inside the piston housing, whereby the controling of the flow of air through the valve(s) controls the rate of motion of the wheel on its spindle, thereby controling rate of descent.

The device of this invention would have a valve capable of being regulated to different levels of air flow so as to permit adaptation of the decelerating systems to different weights of loads. It further provides for a hand-operated method and mechanism for difusing the deceleration system and producing free-fall descent by creating a large opening on the piston housing thus allowing for maximum ventilation of the piston chamber, permitting unrestricted movement of the piston as regards air compression. The free-fall effect would be activated by a pull of a strip of cable running from the piston tube to a handle outside of the pack.

The invention may be better understood by making reference to the following Figures.

THE FIGURES

Figure 4:
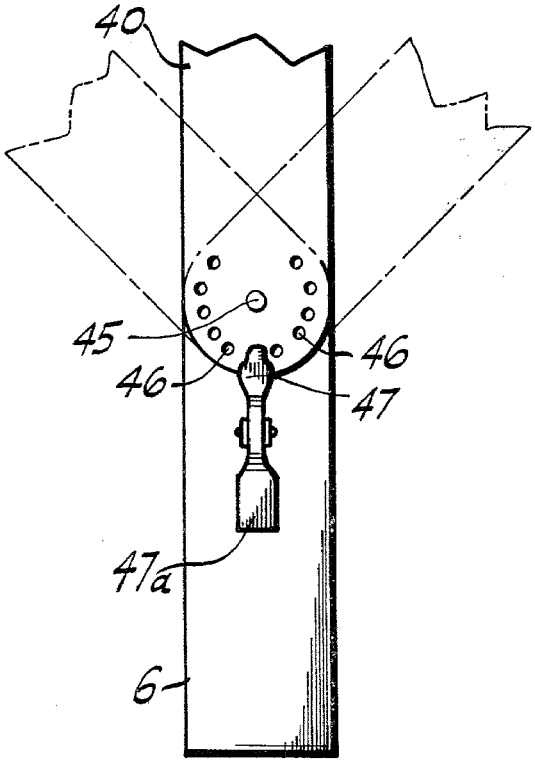
Figure 3:
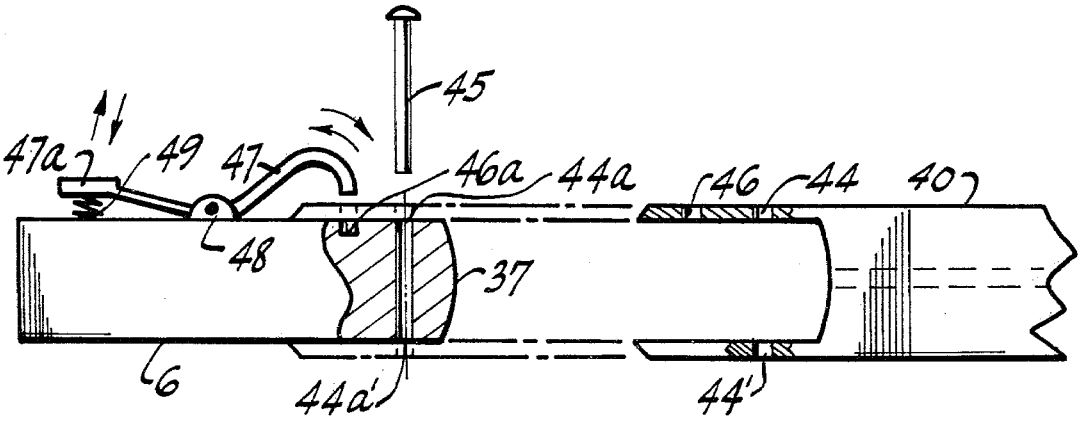
FIG. 3 shows a front-side view diagrammatically of the wire guide supports and jointing thereof for its folding and adjustable-positions latching, in exploded view.

FIG. 4 further illustrates the structures and mechanism of preceding FIG. 3, in a top in-part view thereof.

Figure 5:
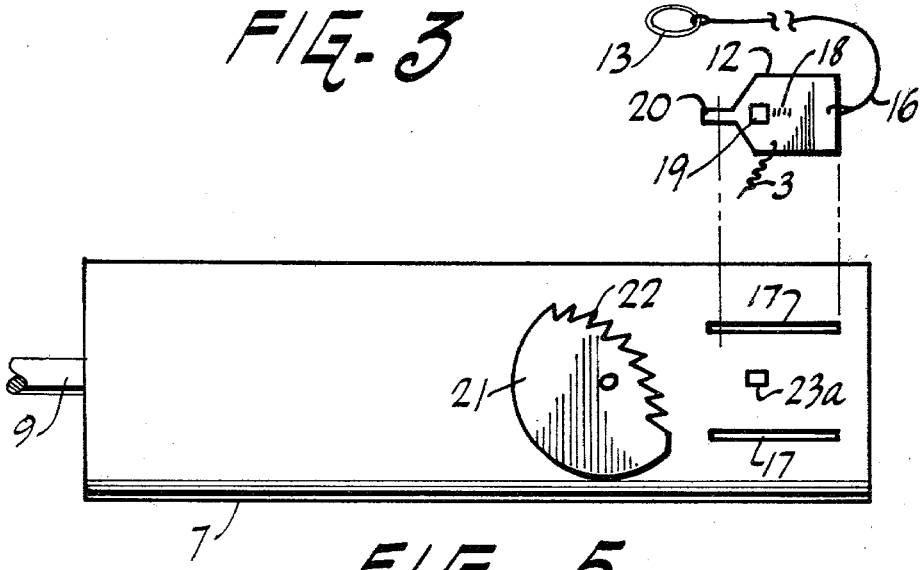

FIG. 5 in exploded view diagrammatically illustrates the descent-control valves and mechanism thereof, in elevation plan view.

Figure 6:
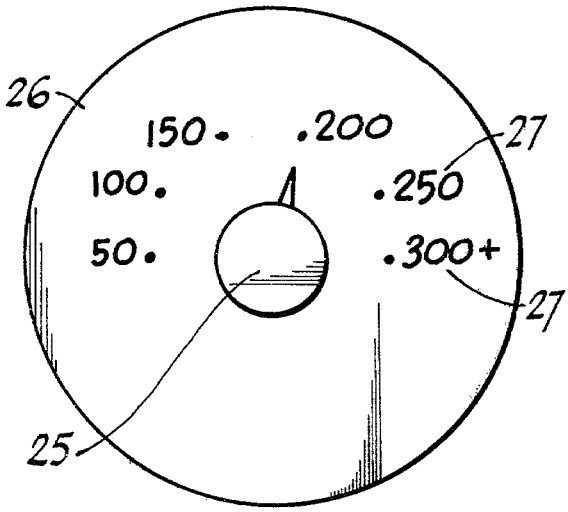

FIG. 6 illustrates diagrammatically further the weight-presetable manual valve control for a controlled rate of descent by adjustment of the degree of venting of the piston chamber by adjustment of the valve control plate, wheel and the like, shown in elevation plan view.

Figure 7:
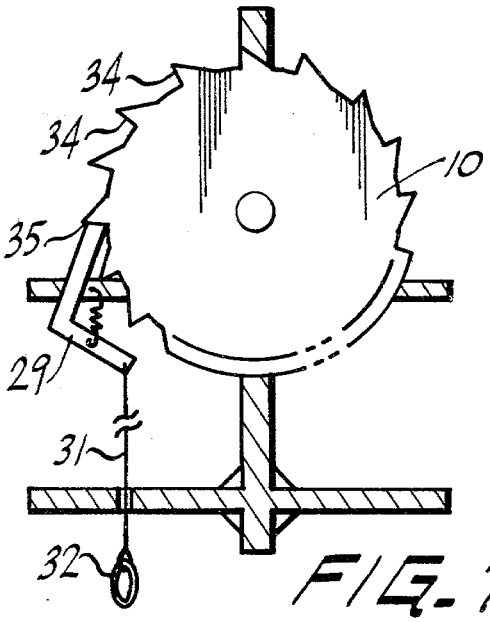

FIG. 7 diagrammatically shows an elevation plan view of the braking system and its mechanism of braking.

BROAD DESCRIPTION OF THE INVENTION

Figure 2:
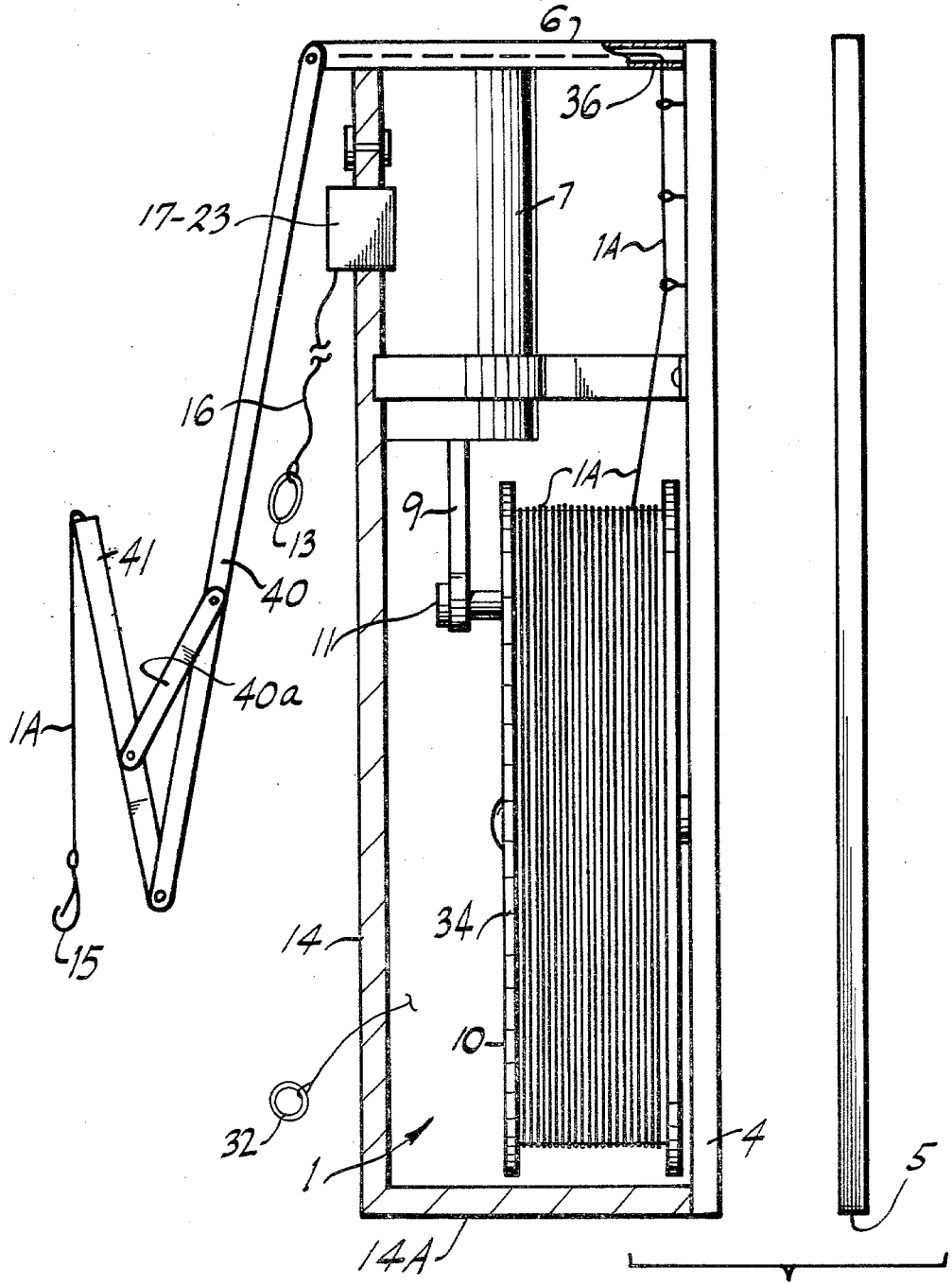
FIG. 2 shows a side view of an embodiment of this invention fully assemble, in a partial side-cross-sectional view.

In greater detail, the reference numeral 1 in the Figures refers to the spool or spindle in the device, made for example of light weight fire resistant plastic, metal or the like. The spool of FIG. 2 would be mounted rotatably on a support as spindle 1, typically by bearings or the like by conventional technique. On the spool there is reeled a strip of wire made for example of steel cable ($\frac{1}{8}$ inch diameter holds 1200 lbs., and $\frac{1}{4}$ inch diameter holds 2500 lbs.), or any other suitable wire-like material. The strip of wire would be about 1500 feet long (longer than the World Trade Center Buildings in New York City from their heights). There is a piston and piston-housing 7 connected to the spool operatively by means of a piston shaft 9. The piston shaft is attached rotatably on one end to the piston and mounted rotatably on its other side on the spindle 1 by bearings protruding from the top flat side 10 of the spool 1, and secured by a bolt 11. The piston travels back and forth inside its housing 7. The piston is mounted air tight inside its piston housing 7, and it necessitates air flow at the base of the piston housing in order for the piston to continue to move. Air flow inside said piston tube is regulated by valve(s) located at one end of the piston chamber. The rotating motion of the spindle 1 corresponds to the up-and-down motion of the piston inside its piston housing 7.

The valve proposed in this embodiment is shown in the FIGS. 5 and 6 and includes an opening 23*a* on the piston housing 7 and a plate 12 that covers the opening in airtight manner. The plate 12 is mounted on the piston housing 7 in such a way that it can move back-and-forth between the slotted bars 17. There are a series of minute openings (holes) 18 on the plate 12 as well as a larger opening 19 at the bottom of the series of minute openings 18. The openings 18 can be positioned directly over the opening 23*a* on the piston housing 7 so that movement of air can be regulated by moving the plate 12 upwards or the openings 18 on the plate can be positioned beyond the opening 23*a* on the housing 7, moving it downwardly. The plate 12 is brought downwardly by a pull spring 3 attached to the plate 12 on one end and attached to one of the slotted bars on the housing itself, at the other end. By moving the plate 12 upwardly, the series of openings on the plate would be exposed one by one to the opening 23*a* of the piston housing. When on its forward-most position, the larger opening on the plate allows maximum air flow in the piston housing thus enabling the piston free movement and allowing thereby free-fall-descent of this device, by allowing the spindle to rotate freely and the wire 1A accordingly to unreel freely from the spindle 1. The plate 12 is moved forward by pushing back end 20 of the plate 12 by means of a calibrated adjusting wheel 21 having various degrees of elevated surface 27. The tail end 20 of the plate 12 rests on any of the elevating surfaces 22 on the calibrated adjusting wheel 21. The plate 12 can be brought to its forwardmost position, i.e., free fall speed, by a pull from a strip of wire 16 (steel cable, or the like) attached on the one end to the top of the plate, and on the other end to a handle 13. A pull on the handle 13 could be made by a person wearing the device for the purpose of achieving free fall. This feature in this device may be useful to a person descending on the side of a burning building for the purpose of rapidly moving past any given area of the burning building which is in flames. The calibrated adjusting wheel 21 adjusts the position of the plate 12 by spinning back and forth, the spinning action being applied manually from outside of the device by turning a dial 25 shown in FIG. 6, which is attached to the calibrated adjusting wheel 21 shown in FIGS. 5 and 6. The calibrated adjusting wheel 21 can be set on a scale surface 26 for different weight loads by following the dial numbers 26 shown in FIG. 6.

A braking system of FIG. 7 of the device, consists of a braking bar 29 which will be made of hard metal, or the like, angular in shape and is mounted rotatably on frame 30. The braking bar 29 which can be made of hard metal or the like, when on its forward position will engage with one end 35 against any of the braking teeth 34 protruding from the bottom flat end of the spool 1. When on its rear position, the braking bar 29 will not interfere with the rotation of the spool 1. The braking bar 29 is kept on its rear position by a pull spring 33 attached on one end of the braking bar 29 and on the other end to the frame 28, of the device. The braking bar 29 will be brought to its forward position by a pull on a strip of cable, which is attached on the one end to the braking bar 29 and on the other end to a handle 32 outside the device. This handle 32 can be pulled by the person wearing the device for the purpose of stopping.

The trajectory of the wire 1A reeled on the spool 1 is guided by wire guide structures 40 and 41 which are attached adjustably to a base bar 4 by frame extension 6. The frame support extension 6 has a cable shaft passageway 38 therethrough for the passage of the spool wire 1A. The spool wire 1A enters at an opening 36 and exits at an opening 37 at the top of the frame support extension 6. The wire guide supports 40 and 41 provide a passageway for the spool wire 1A to the outside of the device, and the loose end thereof of the spool wire 1A is attached to mechanical hool 15.

The base end of the long bar 40 forms a U-shape and is attached to the frame support extension 6, as shown in FIGS. 3 and 4, by fitting rotably on top of the frame support extension thereby guiding the wire 1A. It secured by a running-through bolt 45 extending through passages 44 and 44' and 44*a* and 44*a*'. The rotation of the base of the wire guide supports 40 and 41 on the frame support extension 6 is controlled by a latch 47 latchable in optionally several alternate positions. When the latch 47 is in its rear position, it would not affect the rotation of the wire guide structure 40 on the frame support extension 6; when in the forward position the latch would engage by going through one of the openings 46 around the base of the wire guide support and into a cavity 46*a* in the top of the frame bar locking the base of the wire guide support 40 into a fixed non-rotating position. The latch would be kept in its forward position by a push-spring 49 at the base of the latch 47. The latch 47 can be brought to its rearward position by the person wearing the device depressing the base-end 47*a* of the latch 47 for the purpose of folding and unfolding the wire guide supports 40 and 41 to a position over the head of the person wearing the device that corresponds to the center of gravity of the weight load; i.e., device and person wearing the device. A base of the wire guide support 41 is mounted on the top of the wire guide support 40 in a manner equal to that in which the base of the support 41 is mounted on the frame support extension 6. The supports 40 and 41 can be folded and unfolded on the pack for the purpose of storage.

Figure 1:
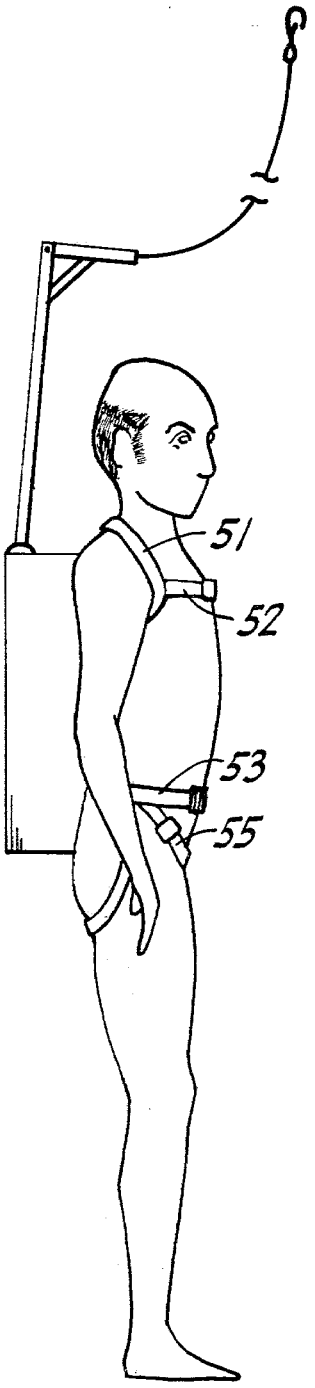
FIG. 1 shows a side view of a human being wearing the typical harness and pack device of this invention.

The harness shown in FIG. 1 of the device is made of eight non-flamable belts; two shoulder straps 51 with a cross belt 52; a two-part waist belt 53; two two part leg belts 55. The harness in use is shown in FIG. 1.

It is further proposed in this presentation that the device of this invention be used to lower children and pets from high altitudes to the ground. Such use can be accomplished by attaching the device to an adequate container, where a child or a pet can be contained and secure. Such container will have padded, soft interior and sufficient space to accomodate its cargo. The container's opening would be covered by a fire resistant seethrough cover.

I claim:

1. A portable fire escape device comprising in combination: a spool support means for mounting a spool and a piston means and a harness means thereon; a spool having elongated wire wound thereon, mounted revolvably on the spool support means; a piston means having a piston, a piston rod and a piston housing, the piston housing being mounted on the spool support means and the piston rod being mounted on the spool operatively for revolving movement of the spool to alternately move the piston rod and piston to and fro backward and forwardly within the piston housing to therby cause compression serving to brake rotary motion of the spool when venting of the piston housing is blocked or limited; piston valve means on said piston housing for selectively venting compressed air from within said piston housing; an elongated rigid wire guide support means including an elongated member for guiding said elongated wire from said spool to a first end of the elongated member and from a second end of the elongated member above the spool support means; and a guide support mounting means for mounting said elongated rigid guide support means and said spool support means in optionally alternate positions of differing angles of the elongated member relative to said spool support means, and for latching the elongated member in a selected position of said alternate positions.

2. A portable fire escape device of claim 1, including a manual adjustment element having an indicator thereon indicative of position, the manual adjustment element being mounted operatively on said piston valve means such that adjustment of the manual adjustment element varies to greater or lesser degrees the amount of venting of air from said piston housing, and a plurality of different indicia indicative of differing weights of persons being arranged on a non-revolvable substrate relative to said indicator such that position of the indicator indicates relative weight of a person to wear the portable support means for safe rate of descent, the non-revolvable substrate being affixed relative to said piston housing.

3. A portable fire excape device comprising in combination: a spool support means for mounting a spool and a piston means and a harness means thereon; a spool having elongated wire wound thereon, mounted revolvably on the spool support means; a piston means comprising a piston, a piston rod and a piston housing, the piston housing being mounted on the spool support means and the piston rod being mounted on the spool operatively for revolving movement of the spool to alternately move the piston rod and piston to and fro backward and forwardly within the piston housing to thereby cause compression serving to brake rotary motion of the spool when venting of the piston housing is blocked or limited; piston valve means on said piston housing for selectively venting compressed air from within said piston housing; an elongated rigid wire guide support means including an elongated member for guiding said elongated wire from said spool to a first end of the elongated member and from a second end of the elongated member above the support means; said elongated member being foldably collapsible along a length thereof into at least two separate end-to-end rods, and being shaped angularly such that an upper portion thereof will be extended above a head of a person wearing the device on the person's back such that a person's head is protectable against striking a wall during descent; and a guide support mounting means for mounting said elongated rigid guide support means and said spool support means in optionally alternate positions of differing angles of the elongated member relative to said spool support means, and for latching the elongated member in a selected position of said alternate positions.

* * * * *